United States Patent [19]

Modrowski et al.

[11] Patent Number: 5,069,762

[45] Date of Patent: Dec. 3, 1991

[54] APPARTAUS FOR IMPROVED CURRENT TRANSFER IN RADIAL CELL ELECTROPLATING

[75] Inventors: Thomas A. Modrowski, Wayne County, Mich.; Larry E. Pfister, Allegheny County, Pa.; Gregory A. Raybuck; James O. Stoddart, both of Wayne County, Mich.

[73] Assignee: USX Corporation, Pittsburgh, Pa.

[21] Appl. No.: 644,065

[22] Filed: Jan. 18, 1991

[51] Int. Cl.[5] ..... C25D 17/06; C25D 17/00

[52] U.S. Cl. ..... 205/137; 204/206

[58] Field of Search ..... 204/28, 206

[56] References Cited

U.S. PATENT DOCUMENTS

| | | | |
|---|---|---|---|
| 2,293,378 | 8/1942 | Allen et al. | 204/206 |
| 3,483,113 | 12/1969 | Carter | 204/206 |
| 3,634,223 | 1/1972 | Carter | 204/206 |
| 3,819,502 | 6/1974 | Meuldijk et al. | 204/206 |
| 3,855,108 | 12/1974 | Bolz et al. | 204/206 |
| 4,500,400 | 2/1985 | Komoda et al. | 204/206 |
| 4,747,923 | 5/1988 | Oda | 204/206 |
| 4,822,457 | 4/1989 | Biber et al. | 204/28 |
| 4,849,083 | 7/1989 | Bertrand et al. | 204/206 |
| 4,885,071 | 12/1989 | Murakami | 204/206 |

*Primary Examiner*—T. M. Tufariello

*Attorney, Agent, or Firm*—D. M. Satina

[57] ABSTRACT

An apparatus for use in a radial cell-type electrodeposition cell having a radial cathodic conductor roll with a central conductor band for improving the transfer of electric current between the to be plated strip and the conductor band. The apparatus includes a holddown roll which contacts the strip proximate the contact point of the strip and the conductor roll prior to the entry of the strip into the electrolyte bath and a second holddown roll which contacts the strip after the strip has exited from the electrolyte bath. The holddown rolls urge the strip uniformly against the conductor band to improve current transfer to the strip.

27 Claims, 2 Drawing Sheets

APPARTAUS FOR IMPROVED CURRENT TRANSFER IN RADIAL CELL ELECTROPLATING

BACKGROUND OF THE INVENTION

The present invention is related to an apparatus for electrodeposition of a metallic coating onto a metallic strip and, more particularly, to a device for improving the transfer of current to the strip in a radial cell type electroplating apparatus.

Steel strip is used in many applications which are subject to conditions which could lead to corrosion, such as body panels on motor vehicles and exterior building panels. In order to improve the corrosion resistance of steel strip, it is often plated with a corrosion resistant material, such as zinc or a zinc alloy. While this coating may be applied through a hot dip process, superior coating adhesion, paintability and formability are obtained through electroplating of the metallic material onto the strip.

Apparatus for electroplating can be of several primary types: horizontal, vertical, or radial. The present invention is directed to a device for use on a radial cell electrodeposition apparatus. In this apparatus a large rotating drum is used as the cathode and the strip is directed into as tank containing electrolyte and is passed about the circumference of the cathodic drum. Electrical current is caused to flow from one or more anodes through the electrolyte solution to the strip as the strip passes through the electrolyte bath about the exterior of the rotating drum cathode. In order to prevent plating of metal on the drum side of the strip, deflector rolls above the electrolyte bath urge the strip into contact with the radial drum in sealing engagement therewith.

The amount of current which is delivered to the cell determines the thickness of the coating plated onto the strip during its immersion within the electrolyte bath. In order to apply a thicker coating or to increase the speed at which the strip travels through the cell while applying a predetermined thickness of coating, higher electrical current is required. In order to achieve the high plating speed required for commercial electrodeposition operations, a relatively high current density must be applied to the strip. If this current is not evenly transferred to the strip, areas of very good contact between the strip and the conductor band of the conductor drum can experience local heating which can result in very small areas of strip discoloration, which are called "hot spots", or of strip deformation, which are called "arc spots". Since this material is usually intended for exterior applications, the customer specifications are very rigid and result int he rejection of material which exhibits even very light defects of this nature. In order to avoid these defects, the plating line may be run at a slower speed than optimum, resulting in productivity losses.

One method of improving the uniformity of the contact between the strip and the conductor band is to increase the tension on the strip pull it more tightly around the conductor drum, which urges it more firmly against the conductor band. However, all steel strip is of a relatively light gauge and therefore has a relatively low yield stress. The tension required to achieve acceptable strip-conductor band contact is just below the yield stress of standard strip gauges (about 0.005 to 0.010 inch [0.13 to 0.25 mm] thick) and is above the yield stress of relatively thin gauge strip and of strip of low yield stress steel grades, such as interstitial free (IF) steels which are used for drawing. Therefore, these steels can not be coated effectively using this procedure.

What is needed is an improved apparatus for use in a radial-type electroplating cell to improve the transfer of current between the conductor band and the strip to prevent current-induced defects and improve productivity while reducing the tension required for effective current transfer.

SUMMARY OF THE INVENTION

An improved radial-type electrodeposition apparatus for plating metal onto one side of a metallic strip according to the invention has a reservoir for retaining a bath of plating electrolyte, a radial cathode partially submerged in the electrolyte bath, the cathode having a central conductor band of a width less than the strip width and non-conducting pliable edges, anodes arranged about the submerged portion of the radial cathode, and deflector rolls located above the electrolyte bath and cooperating with the radial cathode to exert a tensile force on the portion of strip between the deflector rolls, the tensile force urging the metallic strip against the conductor band of the radial cathode with a force normal to the strip surface and the conductor band surface, wherein the improvement comprises means for improving current transfer between the strip and the conductor band, the means contacting the strip proximate the tangent point of the strip with the radial cathode and imparting a contact force normal to the strip surface to urge the strip uniformly against the conducting band of the radial cathode, the contact force permitting a reduction in the amount of tensile force required for uniform current transfer between the strip and the conducting band.

DESCRIPTION OF A PREFERRED EMBODIMENT

Figure 1:
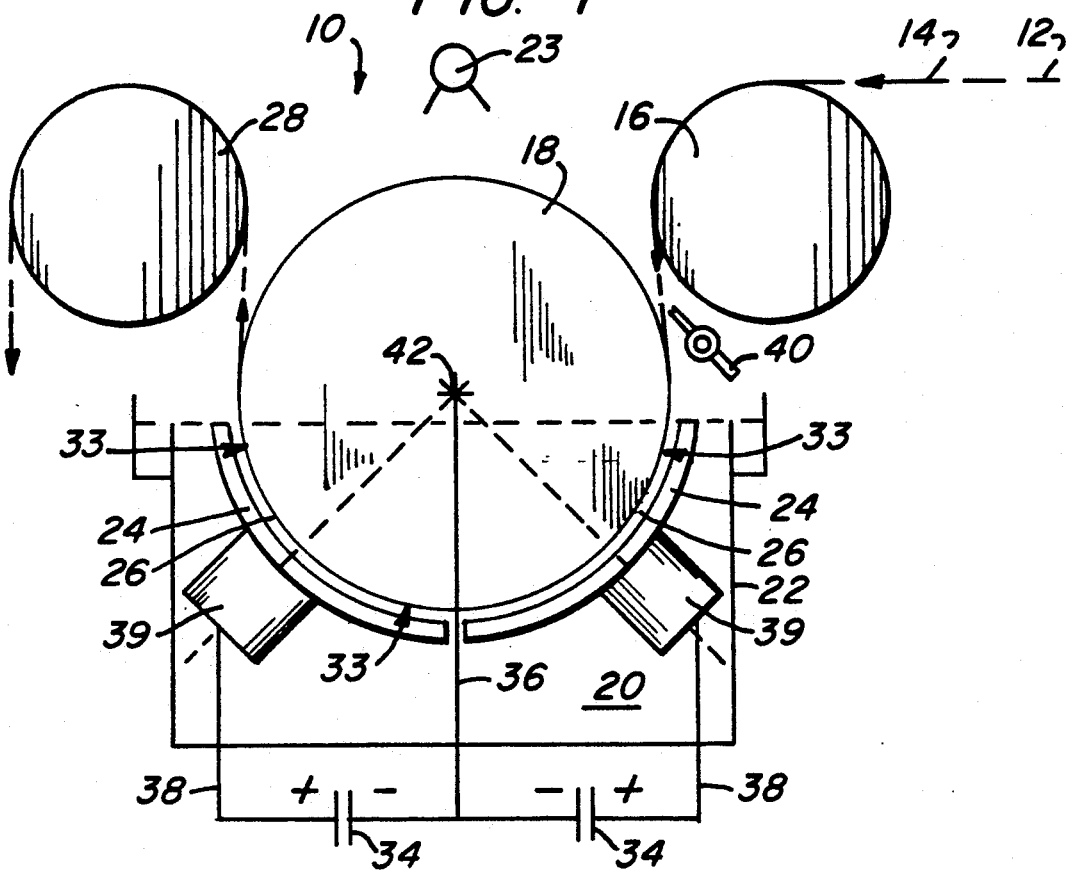
FIG. 1 is a side elevational view of a prior art radial cell for electroplating of metal strip.

The invention is particularly applicable for use on a conventional radial cell electroplating system, such as that described in U.S. Pat. No. 4,822,457, the specification of which is herein incorporated by reference. FIG. 1 illustrates a single conventional radial-type electroplating cell 10 which is generally used in combination with other plating cells arranged so that within each cell a coating of a pre-determined thickness is deposited onto the strip such that the total coating deposited by the system of individual plating cells is of the desired thickness. Within each plating cell 10 a steel strip 12 is passed in a direction 14 about the exterior of the deflector roll 16. Deflector roll 16 directs the strip downwardly around conductor roll 18 which is partially submerged in bath 20 of the electrolyte solution contained within tank 22. A fluid, usually water or electrolyte is sprayed through sprays 23 onto the conductor roll 18 to prevent drying and caking. Anodes 24 are provided in close proximity about conductor roll 18 within electrolyte bath 20. The strip 12 is carried by conductor roll 18 through the small gap 26 between conductor roll 18 and anodes 24. The strip then travels upwardly over exit deflector roll 28 and to the next plating cell or out of the system. In the preferred embodiment, conductor roll 18 is approximately 8 feet (2.4 m) in diameter and deflector rolls 16 and 28 are preferably about 54 inches (1.4 m) in diameter.

Figure 2:
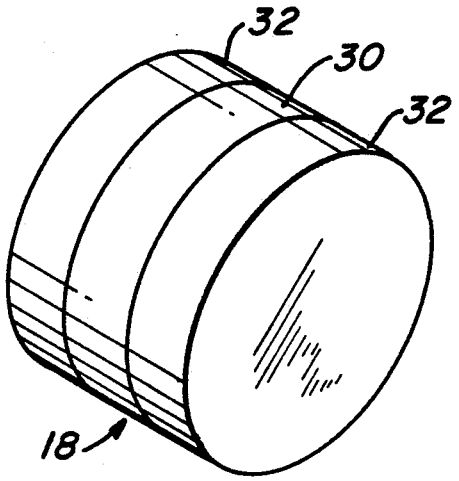
FIG. 2 is a perspective view of a radial drum cathode for use in a radial cell.

FIG. 2 illustrates the preferred construction of the conductor roll. Conductor roll 18 is preferably formed from a single steel roll onto which a conductor band 30 is shrink-fitted. Conductor band 30 is preferably made from a material with superior corrosion resistance and electrical conductivity, such as a hastelloy or wiscalloy alloy. Conductor band 30 is preferably of a width slightly less than the width of the narrowest strip to be electroplated within plating cell 10. The edge portions 32 of conductor roll 18 are covered with a pliable material, such as a polyurethane rubber.

Referring to FIGS. 1 and 2, deflector rolls 16 and 28 cooperate to place the portion of the strip 12 between deflector rolls 16 and 28 in tension. About the portion of the conductor roll 18 contacted by the strip 12, this tensile force is translated into a normal force 33 which acts to urge strip 12 firmly against conductor roll 18 so that the center portion of the strip contacts conductor band 30 and the edge portions of the strip are held firmly against pliable portions 32. Uniform contact between the strip and conductor band is required to prevent areas of superior current transfer, which areas would experience current-induced defects such as hot spots or arc spots. In order to produce this uniform contact in a conventional radial plating cell, the tension between the deflector rolls must be kept at a very high level very near the material's yield stress. The tension also assists in sealing the strip edges against the pliable material at the edges of the conductor roll 18, also called masking, to keep electrolyte from flowing between strip 12 and conductor roll 18 to prevent plating on the side of the strip in contact with conductor roll 18.

Electrical power is supplied from direct current (D.C.) power sources 34 through cable 36 to conductor roll 18. Cables 38 connect the positive side of the D.C. sources 34 to anodes 24 through anode bridges 39. A controlled level of D.C. current is directed through the conductive electroplating liquid containing tons of the metal to be plated onto the strip, creating a cathode-liquid-anode circuit and resulting in the deposition of a controlled thickness of a metal coating onto the steel strip. The anodes can be soluble or insoluble, depending on the anion of the electrolyte used (for example, $C1^-$ for soluble, $SO_4^-$ for insoluble). In insoluble anode systems, plating metal or alloy must be periodically added to replenish the electrolyte. In the preferred embodiment, the zinc anodes are soluble and the zinc dissolved during electroplating acts to maintain the desired level of metal ions in the electrolyte solution for optimum electroplating efficiency.

The electrolyte preferred for use with the invention is a zinc-chloride solution. For the electroplating of a 10–20% Fe-Zn alloy coating on the steel strip, the preferred electrolyte solution is described in U.S. Pat. No. 4,540,472, the specification of which is incorporated herein by reference. A zinc-chloride solution of the type disclosed in U.S. Pat. No. 4,541,903, the specification of which is also incorporated herein by reference, may also be used. Also, the invention is more broadly applicable to systems where sulfate or other electrolyte solutions are used.

The radial cell of the invention preferably includes a header 40 for applying a uniform film of electrolyte solution to the surface of strip 12 prior to entry of the surface into the electrolyte bath. A preferred method for applying the electrolyte and a preferred form of the header are more fully described in U.S. Pat. No. 4,822,457, which has previously been referenced hereinabove. The application of this electrolyte solution to the strip substantially eliminates any non-uniformity in the film carried on the strip from the prior treatment station.

Preferably, the center point 42 of conductor roll 18 is provided with bearings for assisting rotation of the conductor roll about its axis and electrical connection means (not shown) for electrically connecting cable 36 to the conductor roll. It is desirable that this center point 42 be above the level of the electrolyte bath 20 to minimize the need to seal the bearings and electrical connection from the electrolyte. It is also preferred that the deflector rolls 16 and 28 be spaced apart horizontally slightly less than the diameter of conductor roll 18. This spacing provides for wrap-around of the strip about the conductor roll 18 of slightly more than 180 degrees and preferably on the order of 186 degrees.

Figure 3:
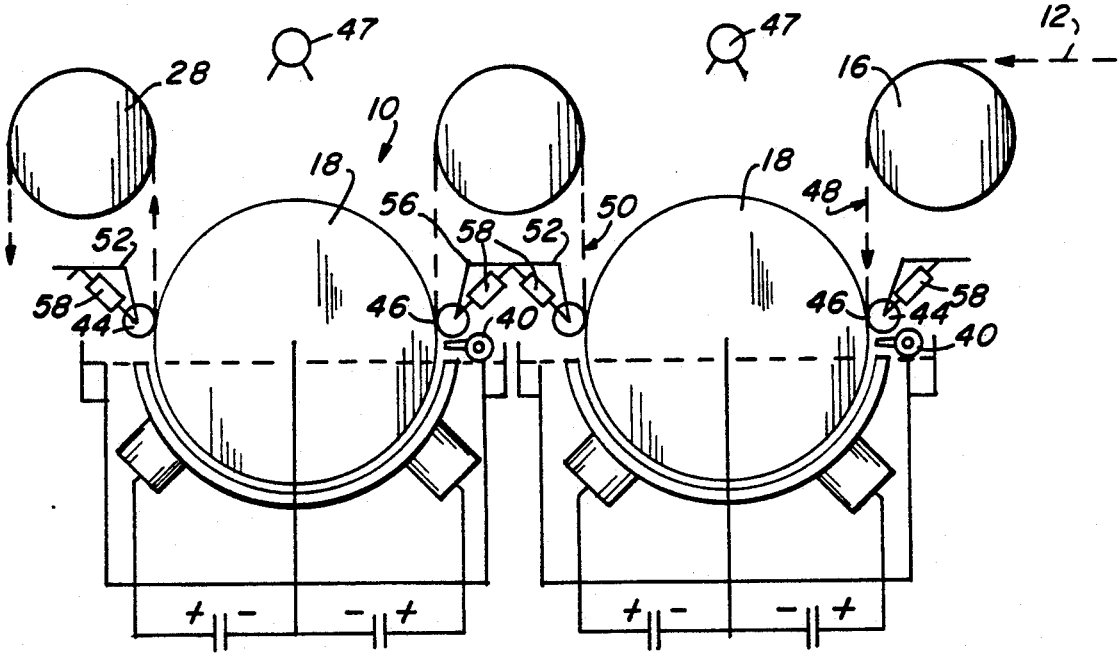
FIG. 3 is a side elevational view of a radial cell for electroplating of metal strip according to the invention.

FIG. 3 illustrates the current transfer improvement device 44 installed on two radial electroplating cells 10 arranged in series. The device 44 preferably contacts strip 12 at approximately the strip contact point 46 or tangent with the conductor roll 18. The device 44 acts to apply a force normal to the strip and conductor roll 18 at the contact point between the device 44 and strip 12. This normal force acts to urge the strip uniformly against the conductor band to provide for uniform current transfer between the conductor band and strip. This normal force offsets the amount of normal force which must be supplied by placing the strip in tension between the deflector rolls 16 and 28 and permits the cell 10 to operate with significantly lower tension between the deflector rolls 16 and 28, permitting the electroplating of lower yield stress materials such as thinner gauge steel and grades of steel having relatively low yield stresses. While it has not been established what the minimum strip tension will be when using the device, an experimental run at less than 60% of the line tension specified for use without eh device was successful and even greater reductions are believed possible.

Also, the device presents further advantages. A fluid, usually water or electrolyte, is sprayed through sprays 47 onto the conductor drum 18 to prevent drying and caking on the conductor band since the associated debris could undesirably mark the strip. The fluid from these sprays can cause the strip to lift from the drum surface as the strip speed is increased, minimizing the electrical contact between the strip and conductor band. The device prevents this hydroplaning by urging the strip against the conductor band with sufficient force to overcome the force of the fluid film.

The device 44 has been successfully tested to contact the strip 12 at the tangent point 46 and up to 1 degree below the tangent point. It is expected that slight deviations from this range would also be satisfactory. However, as the contact point of the device 44 with the strip is moved higher above tangent 46, device 44 will impart undesirable bending stresses into the strip. Depending on the profile of device 44, these bending stresses can result in creasing of the strip caused by the device 44 or creasing of the strip caused by contact of the strip with the conductor band 30 of conductor roll 18. Therefore, the preferred range of contact of device 44 with strip 18 is between 0 and 1 degree below the contact point 46.

In the preferred embodiment illustrated in FIG. 3, device 44 according to the invention is provided on each side of each conductor roll 18. The use of device 44 only on the entry side 48 of conductor roll 18 would result in improved results over the use of no device. However, if the device is used only on the exit side 50 of conductor roll 18, electrolyte will continue to find its way between strip 12 and conductor roll 18, resulting in poor contact and undesirable plating of metal on the side of the strip in contact with the conductor roll 18. It is preferred to have a device 44 on each side of the conductor roll since the two devices cooperate to hold the strip 12 firmly against the conductor roll 18 to permit the use of higher current for electroplating without the creation of hot spots or arc spots on the strip. As the line tensions are reduced, the device 44 on the exit side 50 also assists in maintaining the proper tracking of the strip on conductor roll 18, that is, the strip is kept near the center of conductor roll 18.

Device 44, which can be referred to as a holddown roll, is preferably mounted on a stationary frame member such as frame 52 and is biased against the strip with an adjustable force. Support 54 is attached at one end to device 44 and is pivotably attached to frame 52 at pivot point 56. A biasing device 58 attaches between frame 52 and device 44 to urge device 44 against the strip. Preferably, biasing device 58 can urge the device 44 against strip 12 with a measurable and controllable pressure. Also, it is preferred that the biasing force can be released for strip feeding. Therefore, in the preferred embodiment, biasing member 58 takes the form of a hydraulic or pneumatic cylinder.

If the biasing force is too low, strip to conductor band contact will not be sufficiently improved to avoid current induced defects in the strip surface. The minimum biasing force is believed to be on the order of 10 psi (0.70 kg/cm$^2$). The preferred range for the biasing force is 15 to 45 psi (1.1 to 3.2 kg/cm$^2$).

Figure 4:
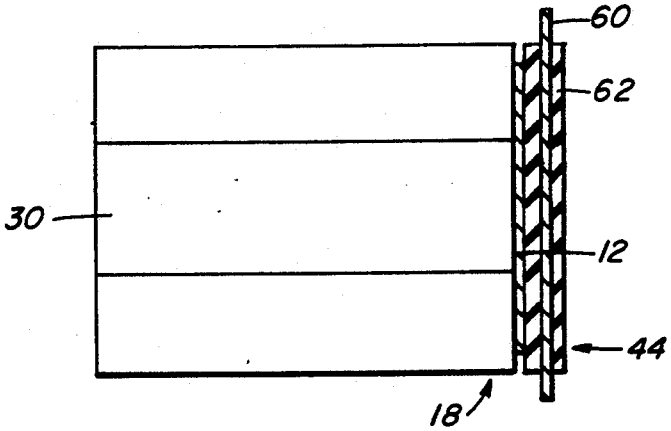
FIG. 4 is a sectional plan view of the improved current transferring device according to the invention taken through the axis of the device.
Figure 5:
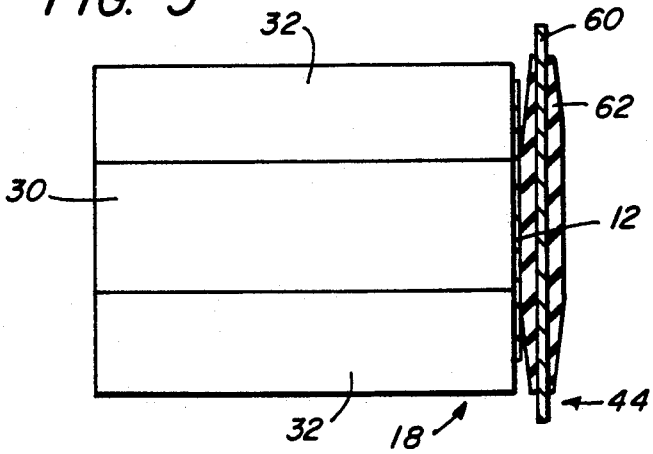
FIG. 5 is a sectional plan view of an alternate embodiment of an improved current transferring device according to the invention taken through the axis of the device.

FIG. 4 illustrates a cross sectional view of device 44 mounted in contact with strip 12 to urge the strip against conductor roll 18. Conductor roll 18 is generally on the order of 84 to 86 inches wide. Conductor band 30 is generally approximately 29 inches wide and is mounted about the center of conductor roll 18. Device 44 can take the form illustrated in FIG. 4 whereby it is as long as the conductor roll is wide. In this form, device 44 will be about 84 to 86 inches. The device has also been successfully tested in a profile whereby device 44 contacts strip 12 over a width just slightly greater than that of conductor band 30. One embodiment of a device which so contacts the strip is illustrated in FIG. 5. An alternative embodiment (not shown) of such a device would be a device which is only as long at the width of contact desired between device 44 and the strip, for example, 30 inches.

Device 44 is preferably formed using a solid center mandrel 60 of a corrosion resistant material, such as titanium bar stock. A relatively soft roll material 62, such as polyurethane, is mounted about mandrel 60 for rotation with the mandrel. The mandrel is mounted onto support 54 to rotate with respect to the support such as through the use of bearings (not shown).

A header is preferably mounted for applying a uniform film of electrolyte solution to the surface of the strip 12 after it is contacted by device 44 and before it enters the electrolyte bath 20. Various irregularities in the film carried on the strip from the prior cell caused by the deflector roll or by device 44 are eliminated in this manner so that the metallic coating applied within the electrolyte bath is uniform. In particular, the embodiment of device 44 shown in FIG. 5 acts as a squeegee, leaving only a thin film of electrolyte about the center of the strip but a heavier film near the strip edges. Also, in the full width embodiment of FIG. 4, the processing of strip of different widths can lead to slight grooves in device 44 which will produce a nonuniform film on the strip. These irregularities, which could lead to corresponding irregularities in the electrodeposited coating, are eliminated by applying sufficient additional electrolyte to the strip after it is contacted by the device but prior to its entry into the electrolyte bath to form a uniform film.

In operation, strip 12 is threaded in direction 14 over deflector roll 16, between device 44 and conductor roll 18 through the gap 26 between anode 24 and conductor roll 18, between device 44 on the exit side 50 of conductor roll 18 and conductor roll 18 and over deflector roll 28. The biasing member 58 is then engaged to apply a predetermined force through support 54 to urge device 44 against strip 12 and to urge strip 12 against the conductor band 30 of conductor roll 18 with a predetermined force. This procedure is repeated for each plating cell 10 of the system. The deflector rolls 16 and 28 are rotated to cause strip 12 to pass through electrolyte bath 20. D.C. current is applied between the anode 24 and cathode drum 18. Electrolyte is caused to flow through header 40 into contact with the strip 12. Within each cell 10 metal ions migrate from the anode through gap 26 resulting in a coating of a predetermined thickness of zinc or zinc alloy being plated onto strip 12. Strip 12 is then caused to enter the next cell in the coating system, the number of cells being determined by the total coating thickness required of the line and the coating capability of each cell 10. Each anode 24 is rated at a specific current. At the maximum current, a maximum line speed achievable is based upon calculations of the current density and the thickness of coating which will be achieved within each cell.

Through use of device 44, the strip is held firmly in contact with conductor band 30 at reduced strip tension. Thereby, excellent uniformity of current transfer is achieved at the contact point between the strip and the entire width of the conductor band 30, reducing the frequency of current-induced defects on the strip by reducing the number of small local areas of high current transfer to the strip. Also, device 44 holds strip 12 against the pliable edge portions 32 in sealing engagement therewith to prevent the electrolyte from flowing between strip 12 and conductor roll 18 to prevent plating on the side of the strip in contact with conductor roll 18. By performing these two functions, the amount of tension which must be applied to the strip between deflector rolls 16 and 28 is reduced, thereby enabling the electroplating of lighter gage, wider and softer steels such as interstitial free steels.

What has been described above are preferred embodiment of the invention and the invention is not limited thereto. Other embodiments within the scope of the invention will be readily apparent to those skilled in the art.

We claim:

1. An improved radial-type electrodeposition apparatus for plating metal onto one side of a metallic strip, the apparatus comprising a reservoir for retaining a bath of plating electrolyte, a radial cathode partially submerged in the electrolyte bath, the cathode having a central conductor band of a width less than the strip width and non-conducting pliable edges, anodes arranged about the submerged portion of the radial cathode, and deflector rolls located above the electrolyte bath and cooperating with the radial cathode to exert a tensile force on the portion of strip between the deflector rolls, the tensile force urging the metallic strip against the conductor band of the radial cathode with a force normal to the strip surface and the conductor band surface, wherein the improvement comprises means for improving current transfer between the strip and the conductor band, said means contacting the strip proximate the tangent point of the strip with the radial cathode and imparting a contact force normal to the strip surface to urge the strip uniformly against the conducting band of the radial cathode, the contact force permitting a reduction in the amount of tensile force required for uniform current transfer between the strip and the conducting band.

2. An apparatus according to claim 1, wherein said means for improving current transfer comprises a holddown roll.

3. An apparatus according to claim 2, wherein said means for improving current transfer contacts the strip before the strip enters the electrolyte bath.

4. An apparatus according to claim 3, wherein said means for improving current transfer comprises a second holddown roll adapted to contact the strip after it exits the electrolyte bath.

5. An apparatus according to claim 3, wherein said holddown roll contact the strip across the entire width of the strip.

6. An apparatus according to claim 3, wherein said holddown roll contacts only a portion of the strip, the portion being slightly wider that the conductor band.

7. An apparatus according to claim 1 further comprising header means for applying a uniform film of electrolyte to the strip surface after the strip is contacted by said holddown roll but before the strip enters the electrolyte bath.

8. An apparatus according to claim 1, wherein the anodes of the electrodeposition apparatus are soluble and the electrolyte solution comprises chlorides.

9. An apparatus according to claim 1, wherein the anodes of the electrodeposition apparatus are insoluble and the electrolyte solution comprises sulfates.

10. An improved radial-type electrodeposition apparatus for plating metal onto one side of a metallic strip, the apparatus comprising a reservoir for retaining a bath of plating electrolyte, a radial cathode partially submerged in the electrolyte bath, the cathode having a central conductor band of a width less than the strip width and non-conducting pliable edges, soluble anodes arranged about the submerged portion of the radial cathode, and deflector rolls located above the electrolyte bath, the strip passing over one deflector roll, into the electrolyte bath about the conductor roll, out of the electrolyte bath and about a second deflector roll, the deflector rolls cooperating with the radial cathode to exert a tensile force on the portion of strip between the deflector rolls, the tensile force urging the metallic strip against the conductor band of the radial cathode with a force normal to the strip surface and the conductor band surface, wherein the improvement comprises a holddown roll adapted to contact the strip proximate the tangent point of the strip with the radial cathode and to urge the strip uniformly against the conducting band of the radial cathode, the holddown roll having a non-metallic surface, the contact force permitting a reduction in the amount of tensile force required for uniform current transfer between the strip and the conducting band.

11. An apparatus according to claim 10, wherein a holddown roll contacts the strip before the strip enters the electrolyte bath.

12. An apparatus according to claim 11, further comprising a device for depositing a uniform film of electrolyte on the portion of the strip between the holddown roll and the electrolyte bath.

13. An apparatus according to claim 12, wherein a second holddown roll contacts the strip after the strip exits from the electrolyte bath.

14. An apparatus according to claim 13, wherein said holddown rolls are urged against the strip with a force in the range of 10 to 45 psi (0.70 to 3.2 kg/cm$^2$).

15. An apparatus according to claim 14, wherein said holddown rolls are urged against the strip with a force in the range of 15 to 25 psi (1.1 to 1.8 kg/cm$^2$).

16. An apparatus according to claim 10, wherein said holddown roll is as wide as the conductor roll.

17. An apparatus according to claim 10, wherein said holddown roll contacts a portion of the strip only slightly wider than the conductor band.

18. An improved method of electroplating a metallic coating onto a metallic strip using a radial-type electrodeposition apparatus, the apparatus comprising a radial cathodic conductor roll having a central conductor band and pliable edges, an electrolyte bath, anodes in close proximity to the conductor roll within the electrolyte bath, and first and second deflector rolls located above the electrolyte bath, the conductor roll being partially submerged in electrolyte bath, the method comprising threading a metallic strip over the first deflector roll, about the exterior of the conductor roll, into the electrolyte bath between the conductor roll and the anodes, out of the electrolyte bath and over the second deflector roll, tensioning the strip between the first deflector roll, the conductor roll and the second deflector roll to a tension level sufficient to urge the strip against the conductor band for transferring current to the strip, and rotating the deflector rolls to cause the strip to pass through the electrolyte bath, the improvement comprising contacting the strip at about the point of contact between the strip and the conductor roll prior to entry of the strip into the electrolyte bath and uniformly urging the strip against the conductor band and reducing the tension level on the strip.

19. A method according to claim 18, wherein said contacting and urging are performed with a holddown roll.

20. A method according to claim 19, wherein a second holddown roll contacts the strip after it has exited from the electrolyte bath at about its tangent point with the conductor roll and urges the strip uniformly against the conductor band.

21. A method according to claim 20, wherein the force with which the two holddown rolls urges the strip against the conductor band is in the range 10 to 45 psi (0.70 to 3.2 kg/cm$^2$).

22. A method according to claim 19, further comprising applying electrolyte to the surface of the strip after the strip has been contacted by the holddown roll and before the strip enters the electrolyte bath to form a uniform film of electrolyte on the strip.

23. A method according to claim 22, wherein said applying of electrolyte is performed through a spray header.

24. A method according to claim 19, wherein said holddown roll contacts the strip across the full width of the strip.

25. A method according to claim 19, wherein said holddown roll contacts only a central portion of the strip slightly wider than the conductor band.

26. A method according to claim 17, wherein the anodes are soluble.

27. A method according to claim 17, wherein the anodes are insoluble.

* * * * *